US009573748B2

(12) United States Patent
Park

(10) Patent No.: US 9,573,748 B2
(45) **Date of Patent: *Feb. 21, 2017**

(54) SHIPMENT, STORAGE, AND TRANSPORT BAG FOR FRAGILE APPARATUS

(71) Applicant: Bio Hazard, Inc., Los Angeles, CA (US)

(72) Inventor: Kitae Park, La Palma, CA (US)

(73) Assignee: Bio Hazard, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/628,089

(22) Filed: Feb. 20, 2015

(65) Prior Publication Data

US 2016/0244233 A1 Aug. 25, 2016

(51) Int. Cl.

| | |
|---|---|
| ***B65D 81/05*** | (2006.01) |
| ***B65D 81/02*** | (2006.01) |
| ***B65D 33/25*** | (2006.01) |
| ***B65D 33/16*** | (2006.01) |
| ***B65D 77/02*** | (2006.01) |

(52) U.S. Cl.

CPC ..... *B65D 81/02* (2013.01); *B65D 33/16* (2013.01); *B65D 33/25* (2013.01); *B65D 77/02* (2013.01); *B65D 81/051* (2013.01); *B65D 81/058* (2013.01)

(58) Field of Classification Search

CPC ..... B65D 81/113; B65D 58/30; B65D 81/05; B65D 81/107; B65D 81/133; B32B 3/12; A45C 3/00; A45C 7/0022

USPC . 206/523, 583, 592, 446, 443, 521; 190/127

See application file for complete search history.

(56) References Cited

U.S. PATENT DOCUMENTS

| | | | | |
|---|---|---|---|---|
| 4,334,601 | A * | 6/1982 | Davis | A45C 3/00 190/111 |
| 4,339,039 | A * | 7/1982 | Mykleby | B65D 81/107 206/523 |
| 4,681,225 | A * | 7/1987 | Schuster | A45C 3/00 206/426 |
| 4,693,344 | A | 9/1987 | Shuler | |
| 4,773,515 | A * | 9/1988 | Kotkins, Jr. | A45C 7/0068 190/103 |
| 4,830,154 | A | 5/1989 | Gerch et al. | |

(Continued)

FOREIGN PATENT DOCUMENTS

| | | |
|---|---|---|
| GB | 966623 | 8/1964 |

OTHER PUBLICATIONS

World Intellectual Property Organization, International Search Report and Written Opinion for International Application No. PCT/US2015/16956, mail date May 22, 2015, pp. 1-27.

(Continued)

*Primary Examiner* — Steven A. Reynolds

(74) *Attorney, Agent, or Firm* — Jonathan Pearce; SoCal IP Law Group LLP

(57) ABSTRACT

A portable, elongated bag with two opposing ends closeable through the operation of at least one zipper extended from a first end to a second end includes a first padded insert and a second padded insert, each conformed to one of the two opposing ends and the first padded insert comprising a series of at least two concentric, affixed and removable padded portions such that removal of a first of the portions creates an opening of a first size and removal of the second portion enlarges the opening to a second size, both for protective storage of fragile apparatus within the portable, elongated bag.

20 Claims, 6 Drawing Sheets

© 2015 Bio Hazard, Inc.

(56) References Cited

U.S. PATENT DOCUMENTS

| | | | | | |
|---|---|---|---|---|---|
| 5,040,678 | A * | 8/1991 | Lenmark, Sr. | B65D 81/107 | 206/204 |
| 5,105,919 | A * | 4/1992 | Bomes | A45C 3/00 | 150/117 |
| 5,105,970 | A * | 4/1992 | Malone | B65D 90/06 | 206/523 |
| 5,213,215 | A * | 5/1993 | Prevot | B65D 5/509 | 206/446 |
| 5,273,153 | A | 12/1993 | Braun | | |
| 5,427,453 | A | 6/1995 | Cloessner | | |
| 5,462,171 | A * | 10/1995 | Moog | B65D 81/113 | 206/588 |
| 5,476,184 | A | 12/1995 | Hill | | |
| 5,595,806 | A | 1/1997 | Korfmacher | | |
| 5,931,120 | A * | 8/1999 | Burns | A01K 1/0254 | 119/497 |
| 5,974,826 | A * | 11/1999 | Baldwin | A45C 11/20 | 62/457.2 |
| D419,770 | S | 2/2000 | Mogil | | |
| 6,053,317 | A | 4/2000 | Morris et al. | | |
| 6,055,825 | A * | 5/2000 | Choy | B65D 77/02 | 220/1.5 |
| 6,102,204 | A * | 8/2000 | Castleberry | B65D 5/503 | 206/423 |
| 6,325,281 | B1 * | 12/2001 | Grogan | B65D 81/3862 | 220/592.25 |
| 7,150,346 | B2 * | 12/2006 | Renz | A45C 3/06 | 150/117 |
| D629,195 | S | 12/2010 | Jusic | | |
| D629,196 | S | 12/2010 | Jusic | | |
| D629,197 | S | 12/2010 | Jusic | | |
| 2001/0037923 | A1 * | 11/2001 | Godshaw | A45C 13/02 | 190/110 |
| 2002/0195366 | A1 * | 12/2002 | Castleberry | B65D 81/022 | 206/423 |
| 2007/0062638 | A1 | 3/2007 | Carroll | | |

OTHER PUBLICATIONS

Zeikos, "Zeikos ZE-HC36 Deluxe Medium Hard Shell Case With Extra Padding Foam for Cameras, Camcorders, Photographic Equipment and Portable DVD Player," amazon.com, Feb. 6, 2015, 7 pages, http://www.amazon.com/Zeikos-ZE-HC36-Camcorders-Photograpic-Equipment/dp/B001HJTK5Y/ref=sr_1_1? ie=UTF8 &qid=1424469239&sr=8-1&keywords=Zeikos+ZE-HC36.

Vatra, "Tube Cover," vatra.com, Feb. 6, 2015, 2 pages, http://www.vatra.com/product/tube-cover/.

Vatra, "Tube Bag," vatra.com, Feb. 6, 2015, 3 pages, http://www.vatra.com/product/18-tube/.

Matthews, David. "The Top 15 Best Bong Cases Ever," College of Cannabis, Product Reviews, Feb. 6, 2015, 11 pages, http://collegeofcannabis.com/reviews/the-top-15-best-bong-cases/1.

Vatra, "Shuttle Bag," vatra.com, Feb. 6, 2015, 2 pages, http://www.vatra.com/product/shuttle-bag/.

Ryot, "Control Your Own—Smell Safe Pro-Duffle 12," ryot.com, Feb. 6, 2015, 3 pages, https://ryot.com/products/view/92.

Ryot, "Ryot Headcase Large Blue," aqualabtechnologies.com, Feb. 6, 2015, 2 pages, http://aqualabtechnologies.com/glass-accessories-1/protection-caseskyot-headcase-large-blue.html.

Ryot, "Pro-Case Glass Tube Protection Case by Ryot—Small Pro-16," Grasscity.com, Feb. 6, 2015, 3 pages, http://www.grasscity.com/us_enkyot-pro-case-water-pipe-bag-small-pro-16.html#.VOezE7ThHSc.

Pelican Case, "Pelican Case 1560 with Foam—Black," aqualabtechnologies.com, Feb. 6, 2015, 2 pages, http://aqualabtechnologies.com/glass-accessories-1/protection-cases/pelican-case-1560-with-foam-black.html.

Grasscity, "Padded Duffle Bag for Glass Water Pipes—Large—Black or Camouflage," grasscity.com, Feb. 6, 2015, 2 pages, http://www.grasscity.com/us_en/glass-water-pipe-carrying-case-large.html#.VOe0XbThHSc.

Vatra, "Matrix," vatra.com, Feb. 6, 2015, 2 pages, http://www.vatra.com/product/matrix/.

Vatra, "Lock N. Load," vatra.com, Feb. 6, 2015, 2 pages, http://www.vatra.com/product/12-lock-n-load/.

Everyone Does It, "Hand Pipe Hard Case 7 Inches," everyonedoesit.com, Feb. 6, 2015, 5 pages, http://www.everyonedoesit.com/online_headshop/hand-pipe-hard-case-7-inches.cfm?iProductID=10384.

Vatra, "24" Golf, vatra.com, Feb. 6, 2015, 3 pages, http://www.vatra.com/product/24-black-golf/.

Dutch, "Glass Tube Padded Carrying Case—Camouflage—Small," grasscity.com, Feb. 6, 2015, 2 pages, http://www.grasscity.com/us_en/dutch-glass-water-pipe-protective-case-camouflage-large.html#VOe3KLThHSc.

Vatra, "Duffel—Peaceful Warrior," vatra.com, Feb. 6, 2015, 2 pages, http://www.vatra.com/product/duffle-peaceful-warrior-limited-addition/.

Vatra, "Capsule ZT3," vatra.com, Feb. 6, 2015, 2 pages, http://www.vatra.com/product/capsule-zt3/.

Vatra, "Capsule ZT1 6", vatra.com, Feb. 6, 2015, 2 pages, http://www.vatra.com/product/6-capsule/.

Vatra, "24" HBK, vatra.com, Feb. 6, 2015, 2 pages, http://www.vatra.com/product/24-hbk/.

Dude, "Dude Straight with Ice Twist Bong Set—Large," Feb. 6, 2015, 6 pages, http://www.everyonedoesit.com/online_headshop/dude-straight-with-ice-twist-bong-set-large.cfm?iProductID=10084.

DEA, "DEA Straight Cylinder Glass Tube Set in Aluminum Carrying Case," grasscity.com, Feb. 6, 2015, 2 pages, http://www.grasscity.com/us_en/dea-straight-cylinder-glass-tube-set-in-aluminum-carrying-case.html#.VOe6K7ThHSc.

Studiopro, "StudioPRO SP60-005 All-in-One Photography Photo Studio on Location Carrying Bag Lighting Equipment (Black)," amazon.com, Feb. 6, 2015, 8 pages, http://www.amazon.com/StudioPRO-SP60-005- Photography-Location-Equipment/dp/Boojoroofg/ref=sr_1_1? ie=UTF8&qid=1424472871&sr=8-1 &keywords=StudioPRO+SP60-005+All-in-One+Photography+Photo.

Studiopro, "StudioPRO 30 Inch Photography Photo Studio on Location Carry Bag for Lighting Equipment, Carry Case for Light Stands and Equipment," amazon.com, Feb. 6, 2015, 7 pages, http://www.amazon.com/StudioPROPhotography-Location-Lighting-Equipment/dp/Booherymaq/ref=sr_1_2? ie=UTF8 &qid=1424472949&sr=8-2&keywords=StudioPRO+30+inch.

Neewer, "30inchx10inchx10inch/77cmx25cmx25cm Photo Video Studio Kit Large Carrying Bag for Light Stand Umbrella," amazon.com, Feb. 6, 2015, 9 pages, http://www.amazon.com/Neewer-30inchx10inchx10inch-77cmx25cmx25cm-Carrying-Umbrella/dp/B004BR6HGY/ref=sr_1_8? ie=UTF8&qid=1424473071&sr=8-8 &keywords=NEEWER+photo+video.

* cited by examiner

© 2015 Bio Hazard, Inc.

© 2015 Bio Hazard, Inc.

© 2015 Bio Hazard, Inc.

© 2015 Bio Hazard, Inc.

© 2015 Bio Hazard, Inc.

© 2015 Bio Hazard, Inc.

SHIPMENT, STORAGE, AND TRANSPORT BAG FOR FRAGILE APPARATUS

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to shipment, storage, and transport of fragile apparatus.

Description of the Related Art

Various bags and shipping containers have been devised for the shipment and/or storage of fragile apparatus. Examples of fragile apparatus include scientific apparatus (e.g. experimental apparatus, beakers, flasks, vials, glass pipes for use in chemistry, and the like), glassware, glass and porcelain tobacco smoking apparatus such as hookahs or water pipes, musical instruments, hunting equipment, and various other fragile apparatus.

Most containers are designed for shipping and thereafter are thrown away. Some are designed for transport of a particular item and are, therefore, specifically crafted with the item in mind. That is, where protective elements are employed near the fragile apparatus, the protective material is pre-formed with the fragile apparatus in mind so as to carefully protect the apparatus when stored or being transported. Often these containers are formed of a so-called "hard-sided" material such as metal or plastic to resist shocks such as by dropping or being hit.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

Description of Apparatus

Figure 1:
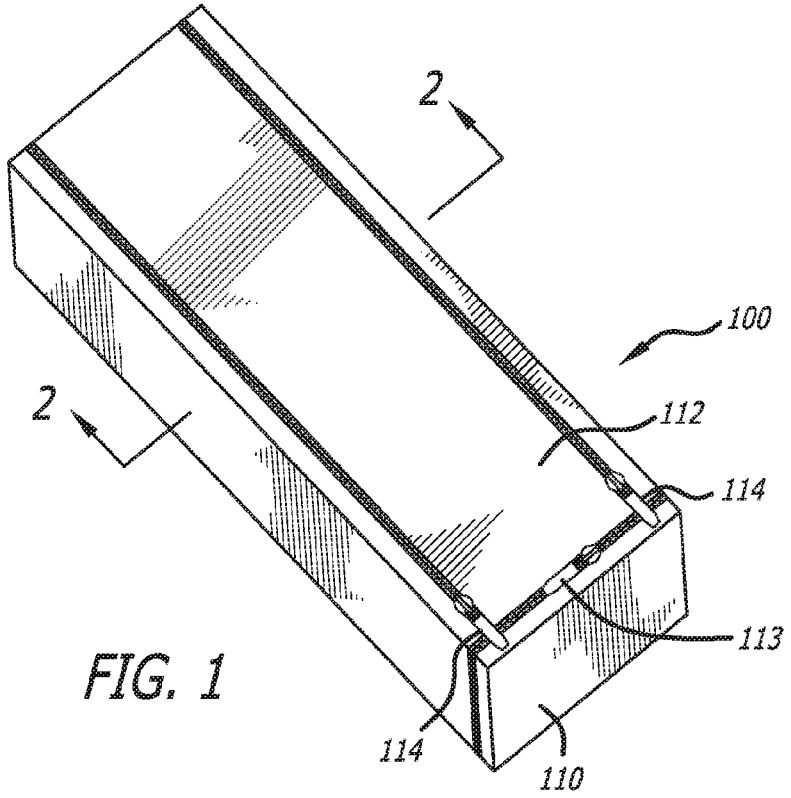
FIG. 1 is an overview of a bag.

Referring now to FIG. 1 an overview of a bag 100 is shown. The bag 100 includes a body 110, a flap 112, and dual zippers 114.

The body 110 may be made of cotton, linen, polyurethane, nylon, or other, similar material. The material used to make the body 110 may be substantially or wholly water proof in order to protect the contents from moisture during travel. The body 110 is elongated with two ends at the points furthest from the center of the bag 100.

The flap 112 may be opened for loading the bag 100 and may be closed to fully-enclose the bag.

The dual zippers 114 serve to close the flap 112 so as to enclose the contents within the bag 100. The dual zippers 114 zip closed (upper left) and a Velcro® patch within the bag 110 may hold the top portion of the flap 112 in place. The dual zippers 114 may zip open and a user may disengage the Velcro® in order to access the contents of the bag 100. Although dual zippers 114 are shown, fewer or more zippers may be employed with a corresponding number of flaps or other openings.

The body 110 may include at one or both ends an additional zipper 113 completely around the circumference of the body 110 of the bag 100. Unzipping this zipper 113 may release additional bag 100 material that has been compressed so as to enable an extendible portion 115 to expand outward so that the bag 100 may accommodate longer fragile apparatus. Preferably, the extendible portion 115 should not extend past the body of any padded insert 140 or 150 (see FIG. 3) so that ridged inserts, like insert 122 or insert 126 may still come in contact with the padded insert 140 or 150 (see FIG. 3) so as to provide support (discussed more fully below). When smaller or shorter fragile apparatus are stored within the bag 100, the end zipper or zippers may be zipped closed to collapse the ends of the body 110 and force the padded inserts 140 or 150 (see FIG. 3) closer together within the bag.

Figure 2:
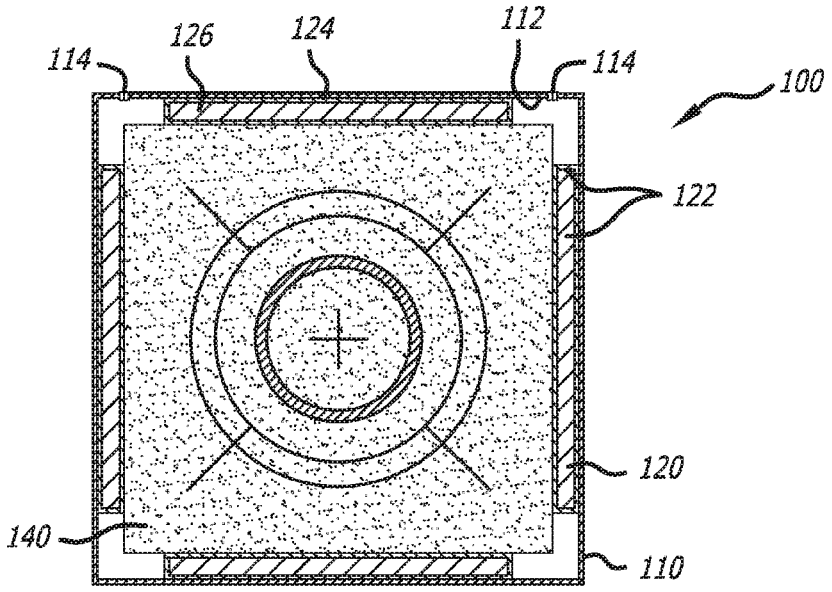
FIG. 2 is a cross-section of a bag.

FIG. 2 is a cross-section of the bag 100. In cross-section, one may still see the body 110, the flap 112, and the dual zippers 114. However, one may also see a series of side pouches, like pouch 120, semi-rigid inserts, like insert 122, a flap pouch 124, a flap insert 126, and an insert 140. The padded insert 140 is shown not extending to the corners of the bag 100 for illustrative purposes only so that the inserts and pouches may be described. In reality, the padded insert 140 compresses slightly and the inserts 122 and 126 are much thinner so that the bag 100 interior fits snugly around the padded insert 140 (and padded insert 150, shown in FIG. 3).

The side and bottom pouches, like pouch 120, are designed to accept the insertion of semi-rigid inserts, like insert 122. As somewhat visible in FIG. 2, the semi-rigid inserts, like insert 122, may extend from end-to-end of the bag 100 so as to overlap with an insert, like insert 140. Overlapping enables the padded inserts, like padded insert 140, to provide a base upon which the semi-rigidity of the insert 122 may act to provide more structure to the bag 100.

The inserts discussed herein are of a semi-rigid to rigid material that is light weight and capable of resisting moderate exterior shocks. The purpose of these inserts is two-fold. First, they provide additional protection for the areas of the bag in between the two padded inserts (140 and 150, shown in FIG. 3) where there is no protective foam. Second, the inserts run end-to-end or substantially end-to-end so that they may provide crush resistance from pressure exerted on either end of the bag 100. The inserts may be manufactured of a molded plastic, or may be of a reinforced foam material. Similarly, the inserts may be non-rigid, but have, at corners or in a pattern, a series of reinforcing metal, ridged plastic or other similar frame structure. Such an insert would use a non-ridged material to maintain a desired shape, while using the ridged material to provide rigidity in a manner similar to tent poles maintaining the shape of tent material once the tent is erected.

The flap pouch 124 including insert 126 are substantially similar to the pouch 120 and insert 122, but the flap pouch 124 may be less than the full width (and potentially length) of the pouch 120 because it is inset within the interior of the flap 112. The flap pouch 124 and insert 126 extend such that the insert 126 extends over each of the padded inserts (140 and 150, shown in FIG. 3) when inserted into the flap pouch 124.

Figure 3:
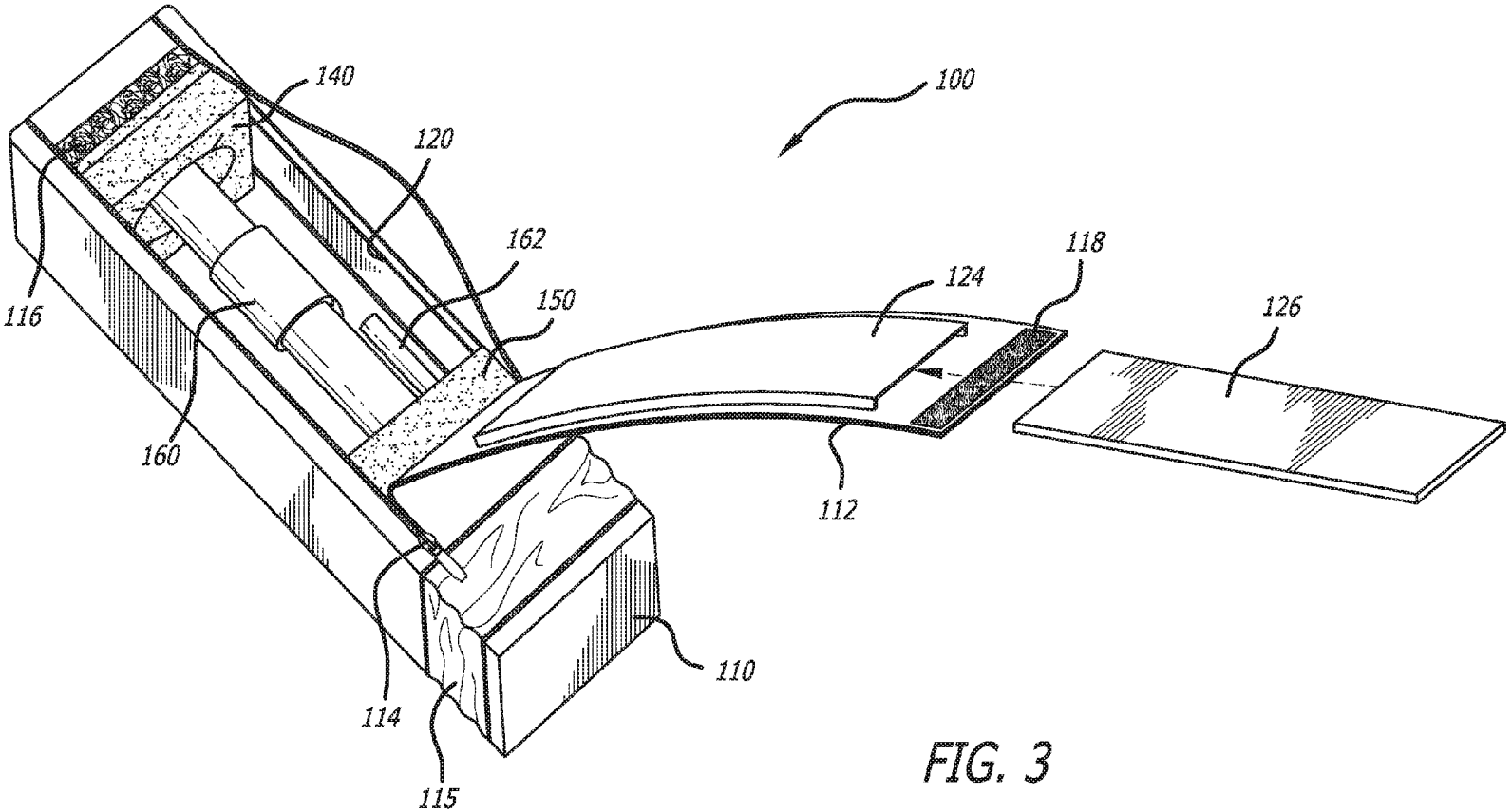
FIG. 3 is an open view of a bag.

FIG. 3 is an open view of the bag 100. in this view, the body 110, flap 112 and dual zippers 114 are visible. However, because the interior of the bag 100 is visible, an interior flap 116, a strip 118, pouch 120, pouch 124, insert 126, padded insert 140, padded insert 150, along with a fragile apparatus 160 and an associated fragile piece 162.

The interior flap 116 may be, for example, Velcro® and may attach, when the bag 100 is closed, to corresponding strip 118 which may also be Velcro®. Other attachment systems may also be used including clips, buttons, snaps, adhesive strips, and other, similar systems. The interior flap 116 and strip 118 serve to hold the flap 112 in place when the bag 100 is being closed or for zipping the dual zippers 114.

The pouch 120 can be seen on the sidewall of the interior of the bag 100. Similar pouches, though not immediately visible, are disposed along each side of the interior of the bag 100. Each houses a semi-rigid insert, like insert 122, and each overlaps, at each end of the bag 100, with padded insert 140 and padded insert 150 so that the inserts may provide support to aid the insert 122 in providing support to the bag 100.

The pouch 124 is shown with the insert 126 removed. Preferably, the inset 126 may be removed or inserted. Pouch 124 may include Velcro, snaps, or a zipper to retain the insert 126 within. The other pouches, like pouch 120, may include similar retention mechanisms. However, these are optional. Preferably, the pouch 124, like pouch 120, is sewn into the interior of the flap 112 (or side or bottom of the bag 100) so that the bag 100 itself may provide a part of the form of the overall semi-rigidity provided by the flap 112 (or bag 100).

Figure 4:
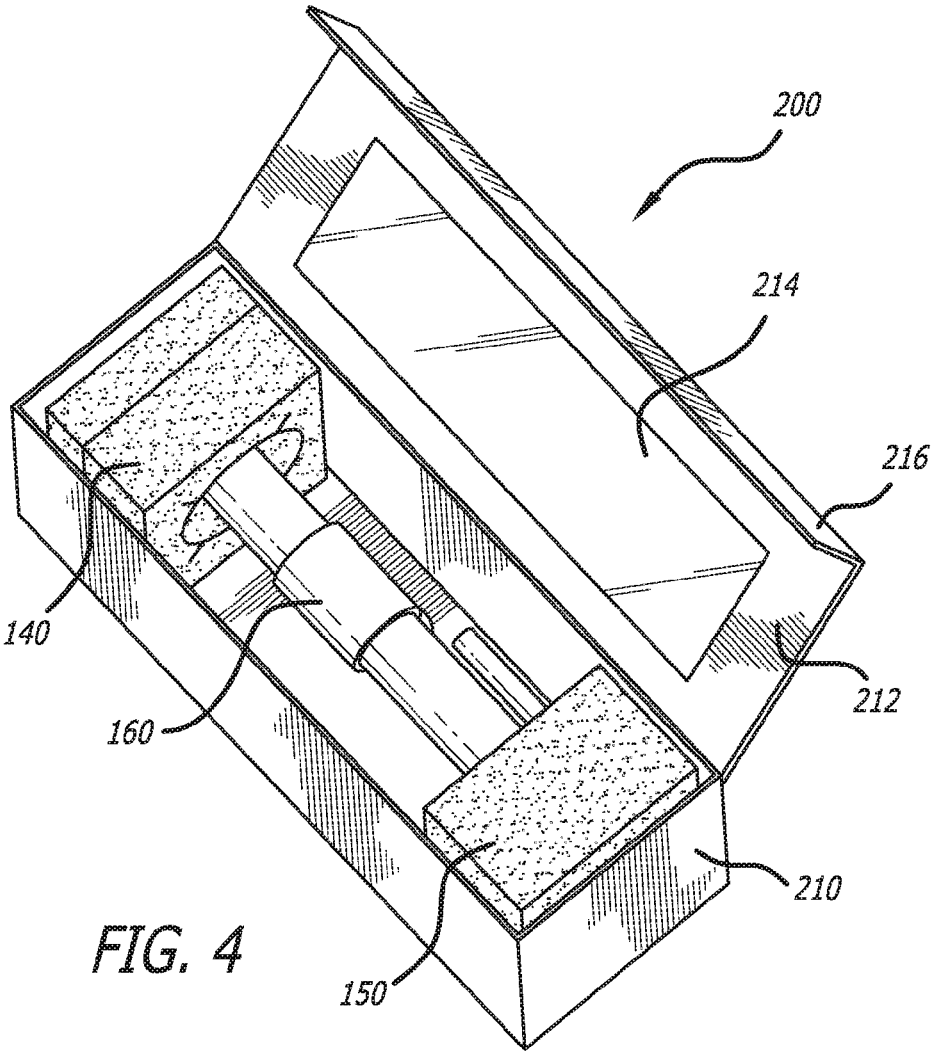
FIG. 4 is an overview of a corrugated box.

FIG. 4 is an overview of a box 200. The box 200 includes a body 210, a flap 212, a window 214, and an inset 216. The body 210 of the box 200 may be made of corrugated material, like cardboard, or may be plastic or coated in a plastic material to aid in avoiding damage from water. The flap 212 may include an inset 216 for insertion into the body 210 when closed so as to retain the padded inserts 140, 150 within the box 200. The window 214 may enable the box 200 to be used for display on a shelf for sale. The exterior of the box 200 may include advertising or a logo of a seller of the fragile apparatus 160 within.

The bag 100 and the box 200 and the fragile apparatus 160 may be provided as a set. When done, the box 200 may store a compressed bag 100 with the inserts 120, 126 placed in the back of the box 200 or along the sides. The compressed bag 100 may, for example, be stored behind the fragile apparatus 160 during transport and when displayed for sale. Once home, a user may discard the box 200, if desired, and the same padded inserts 140, 150 that fit within the box 200 along with the inserts 120, 126 may be used in conjunction with the bag 100, once decompressed. Thus, the bag 100, box 200, and fragile apparatus 160 may be provided as a unit together and the padded inserts 140, 150 may be useable with both.

Figure 5:
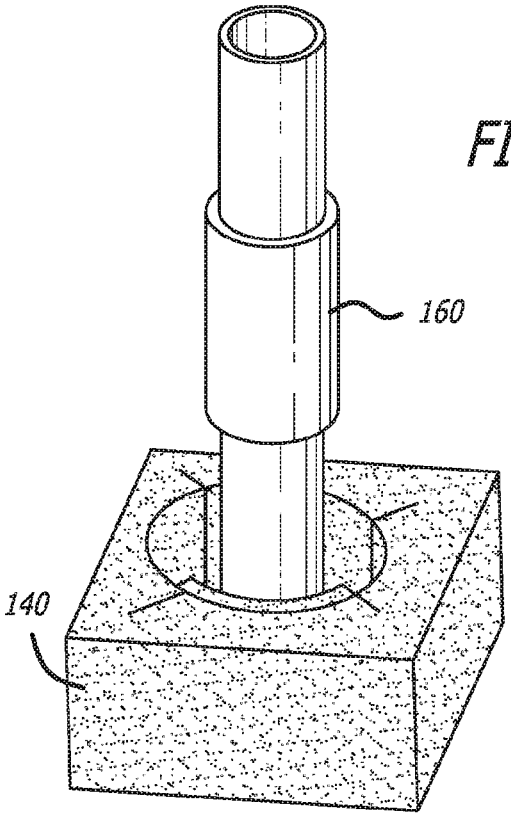
FIG. 5 is a detail view of a first padded insert and an associated fragile apparatus.

FIG. 5 is a detail view of a first padded insert 140 and an associated fragile apparatus 160. The padded insert 140 is designed in such a way, as will be seen in later figures, that it may be used in conjunction with a broad range of fragile apparatus 160 of various shapes and sizes. In this way, a single padded insert 140 may be used for most or all of the fragile apparatus sold by a company or owned by an individual.

Figure 6:
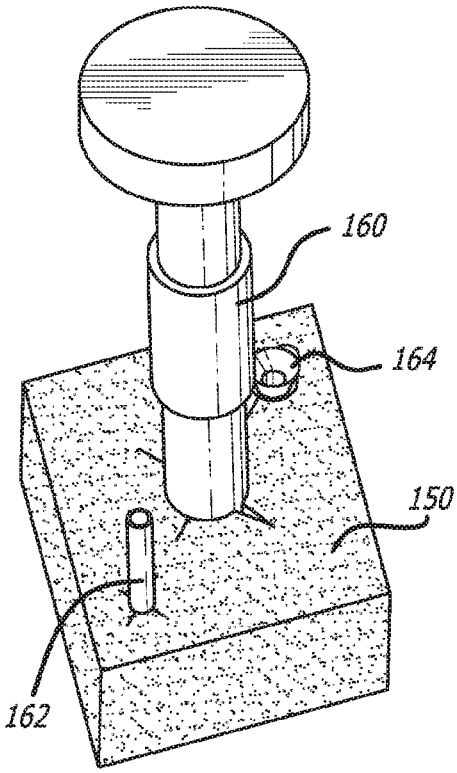
FIG. 6 is a detail view of a second padded insert and an associated fragile apparatus.

FIG. 6 is a detail view of a second padded insert 150 and an associated fragile apparatus 160. This is the same fragile apparatus 160 as shown in FIG. 5. However, this padded insert 150 is also flexible for use with a broad range of fragile apparatus. Also shown are a first accessory 162 and a second accessory 164, inserted into other openings in the padded insert 150. These openings will be discussed below.

Figure 7:
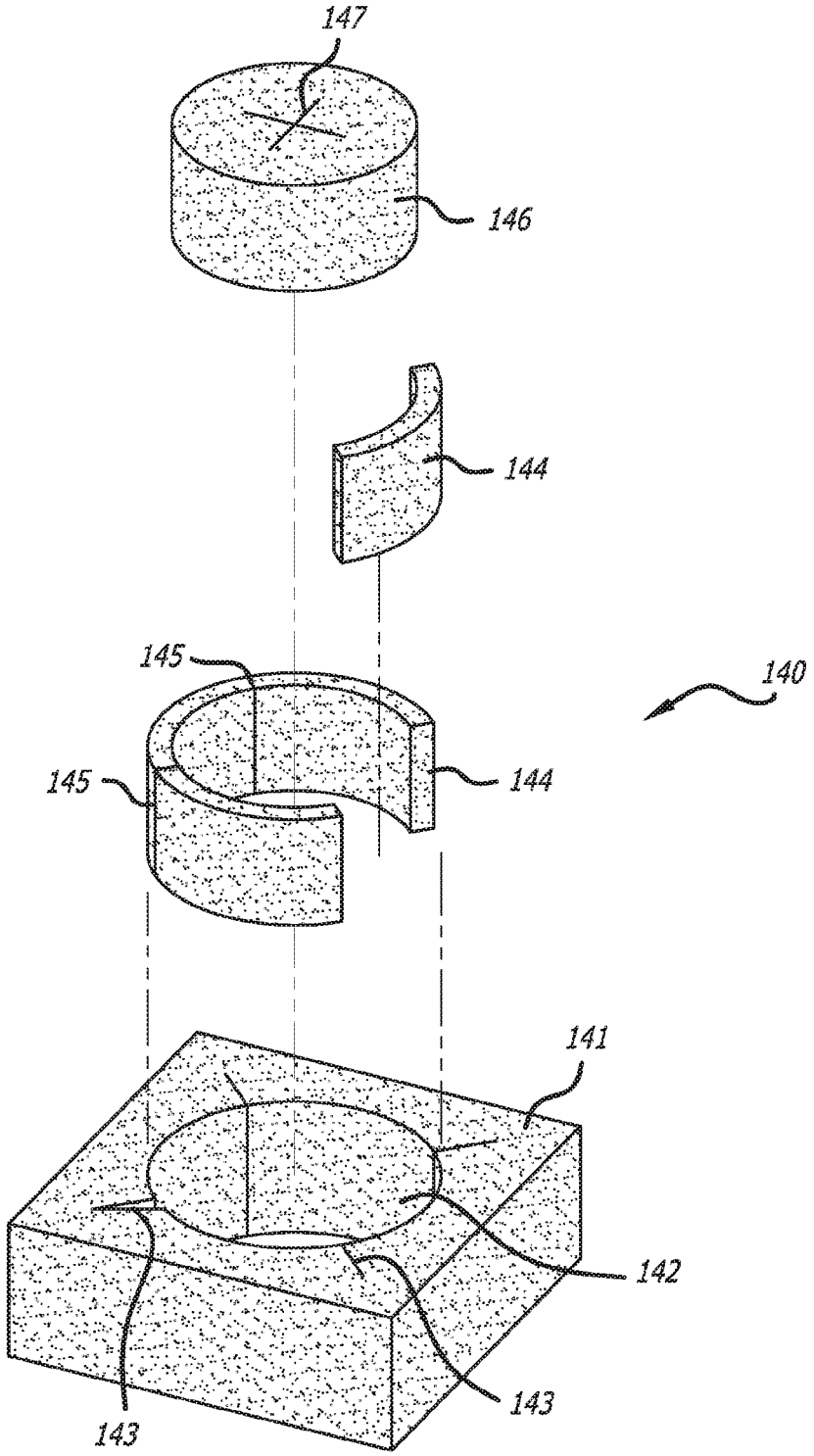
FIG. 7 is an exploded view of the first padded insert.

FIG. 7 is an exploded view of the first padded insert 140. The exploded view includes a base 141, an opening 142, several expansion cuts 143, a sizing ring 144, with a series of cuts 145, and a central insert 146 including an insertion cut 147. More or fewer cuts 145 may be used in the sizing ring 144.

Though the padded insert 140 (and 150, below in FIG. 8) are described as "foam," it should be understood that the material used to make the padded insert 140 (and 150) may be any type of soft, resilient material suitable for use in cushioning, but providing support to a fragile apparatus. For example, polyurethane foams, soft exterior materials like fabrics sewn or formed into a suitable shape, with supportive padded material within, or inflatable air pouches or circular pads may also be used.

The opening 142 in the base 141 is variably expandable by removal of the sizing ring 144 and/or the central insert 146. In some cases, different shapes of the opening 142 (and associated sizing ring 144 and central insert 146 may be used. In this way, the opening 142 can accommodate fragile apparatus of various sizes. The base 141 further includes a series of expansion cuts 143 that enable the base 141 to accommodate even larger fragile apparatus, when needed. Further, these expansion cuts 143 enable an individual to insert a fragile apparatus of a larger base into the opening 142 and have the foam of the base 141 envelope the base of the fragile apparatus to hold it securely in place.

Each piece of the sizing ring 144 is detachably disposed within the opening 142. In some cases, the sizing ring 144 may be made of the same individual block of material as the rest of the padded insert 140 (or base 141). In such cases, sizing ring 144 may remain a part of the base 141 until forcibly detached by a user or when in the process of inserting a fragile apparatus. In this way, the sizing ring 144 may remain a physical part of the base 141 in situations in which the fragile apparatus that is to be inserted is smaller in diameter, but may be permanently or temporarily removed for those that are larger in diameter.

The sizing ring 144 may include a series of cuts 145 in the sizing ring 144 may aid in removal of the sizing ring 144 and may be used to independently remove only part of the sizing ring 144 to better hold a fragile apparatus in place within the opening 142.

Finally, the central insert 146 with the insertion cut 147 is preferably detachably affixed within the opening 141 and further within the sizing ring 144. In situations in which the fragile apparatus is particularly small, it may be inserted within the insertion cut 147 and held in place by the base 141, sizing ring 144, and central insert 146 that are formed of the same foam material from the same physical piece. In situations in which the fragile apparatus is slightly larger, the central insert 146 may be removed by physically detaching the partially pre-cut foam from the remainder of the padded insert 140, while selectively, as desired, leaving the sizing ring 144 in place.

As briefly described above, each of the base 141, central insert 146 and sizing ring 144 may be formed from a single piece of material. The cuts in the material making up the central insert 146 and sizing ring 144 may be intentionally incomplete. In this way, the material making up the base 141, central insert 146 and sizing ring 144 may remain a single piece until detached from one another. For example, some foam may remain in place and attached, but pre-cut, such that a user desiring to remove the central insert 146 will be required to further tear around the edges of the central insert 146 in order to remove it from the base 141.

In some cases, two pieces may make up the base 141, one pre-cut completely through both the central insert 146 and sizing ring 144. A second piece making up the bottom of the base may be glued to each of the base 141, the central insert 146 and the sizing ring 144 on the bottom of each, thus causing each to be removeably attached to one another, but in a way that is relatively easily detachable.

Figure 8:
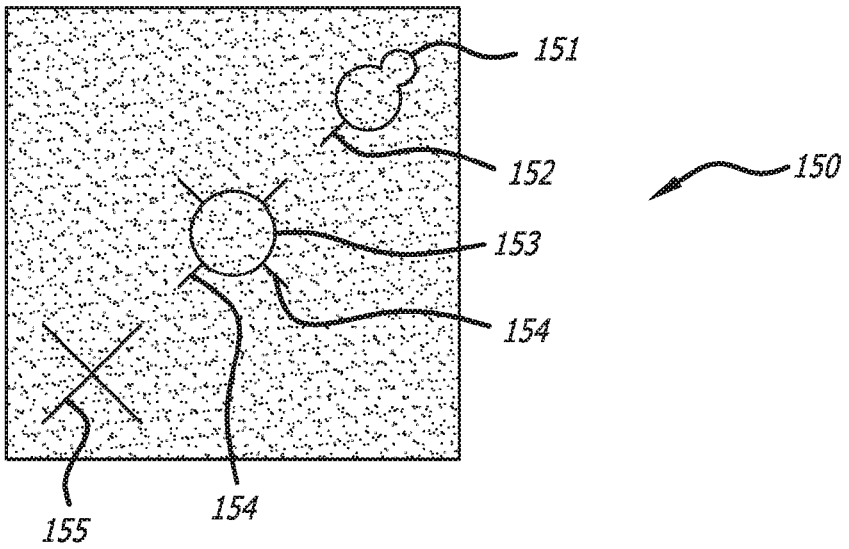
FIG. 8 is a cross-section of the second padded insert.

FIG. 8 is a cross-section of the second padded insert 150. This padded insert 150 includes a first removable insert 153 in the middle of the insert 150. Around the first removeable insert 153 are a series of cross cuts 154 so that, once removed, a fragile apparatus of a slightly-larger size may be accommodated. Further, the cross cuts 154 enable the insert 150 to hold a fragile apparatus in place snugly, by conforming around the fragile apparatus once inserted.

A second removeable insert 151 may include a shape made of two concentric circles in order to accommodate fragile apparatus of a shape cross-sectionally similar to that shape. Further, an expansion cut 152 may also be included in the second padded insert 150 so as to accommodate and snugly hold fragile apparatus of slightly larger diameter.

Finally, a cross cut 155 with an "X" cross-section may accommodate fragile apparatus accessories of a reasonable size.

In each case, the pieces of the fragile apparatus and associated accessories may be held by the second padded insert 150. As with the first padded insert 140, only those portions that need be removed, may be. If not desired, neither the first nor the second removable insert 153, 151 need be removed at all so long as the fragile apparatus being protected by the second padded insert 150 is held in place.

Figure 9:
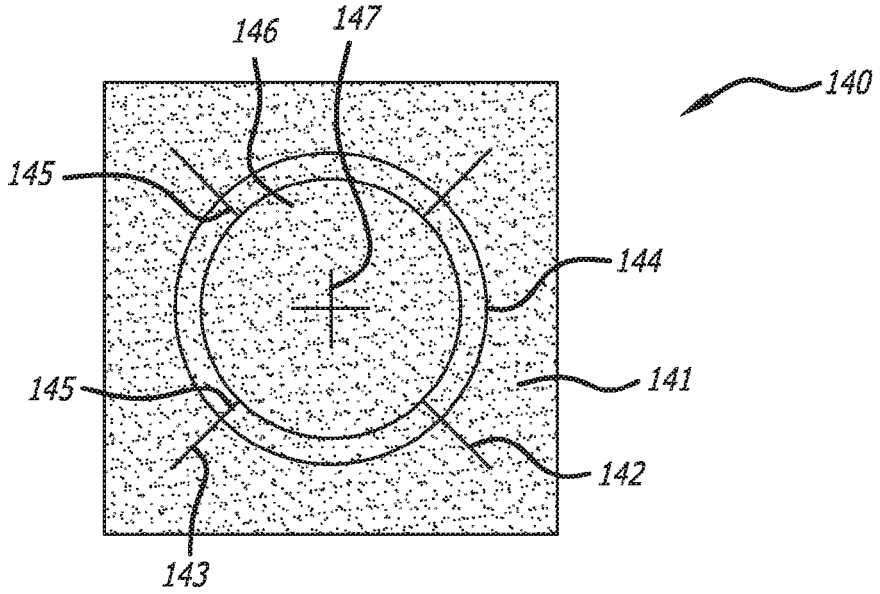
FIG. 9 is a cross-section of the first padded insert.

FIG. 9 is a cross-section of the first padded insert 140. This view shows the a base 141, an opening 142, several expansion cuts 143, a sizing ring 144, each with cuts 145 splitting the sizing ring 144 into quarters, and a central insert 146 including an insertion cut 147.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A system comprising:

a portable, elongated bag with two opposing bag ends closeable through the operation of at least one zipper extended from a first bag end to a second bag end a compressible first padded insert and a compressible second padded insert, each conformed so as to fit within the first bag end and the second bag end;

a second zipper running the circumference of one of the first bag end and the second bag end; and material making up an extendible portion of the portable, elongated bag held in a compressed position by the second zipper such that when the second zipper is unzipped, the extendible portion extends outward and one of the first padded insert and second padded insert fits securely within the extendible portion.

2. The system of claim 1 wherein the at least one zipper is two side-by-side zippers substantially disposed upon two edges of the portable, elongated bag.

3. The system of claim 1 further comprising:

at least two pouches, disposed substantially along the length of two interior sides of the portable, elongated bag; and at least two pliable, rigid inserts disposed within the at least two pouches to provide pliable, rigidity to the elongated bag.

4. The system of claim 1 wherein the portable elongated bag is made of a waterproof material.

5. The system of claim 1 wherein the extendible portion extends outward a shorter distance than the depth of one of a first padded insert and a second padded insert.

6. The system of claim 1 further comprising an elongated shipping box of corrugated material having two ends, a first box end and a second box end, the first box end and the second box end having substantially similar interior dimensions as the first bag end and the second bag end.

7. The system of claim 1, wherein the first padded insert comprises a series of at least two concentric, affixed and removable padded portions such that removal of a first of the portions creates an opening of a first size and removal of the second portion enlarges the opening to a second size, both for protective storage of fragile apparatus within the portable, elongated bag.

8. The system of claim 7, wherein the first portion includes a central, interior cross cut that allows for insertion of apparatus of a smaller diameter than the first portion.

9. The system of claim 7, wherein the first portion includes an anterior cross cut that accommodates the insertion of apparatus of a larger diameter than the opening when enlarged to the second size.

10. The system of claim 7, wherein the second padded insert includes a central opening of a first diameter and an anterior cross cut so as to accommodate the insertion of apparatus of a diameter larger than that of the first diameter.

11. The system of claim 10, wherein the second padded insert includes a cross cut of a second diameter so as to accommodate the insertion of an apparatus of the second diameter.

12. The system of claim 11, wherein the second padded insert includes an opening of a third diameter so as to accommodate the insertion of an apparatus of the third diameter.

13. A system comprising:

a collapsible, elongated bag with two opposing bag ends closeable through the operation of at least one zipper extended from a first bag end to a second bag end;

a first padded insert and a second padded insert, each having an exterior dimension so as to fit within the first bag end and the second bag end;

a second zipper running the circumference of one of the first end and the second end; and material making up an extendible portion of the portable, elongated bag held in a compressed position by the second zipper such that when the second zipper is unzipped, the extendible portion extends outward and one of the first padded insert and second padded insert compresses to fit securely within the extendible portion.

14. The system of claim 13 further comprising an elongated shipping box of corrugated material having two ends, a first box end and a second box end, the first box end and the second box end having substantially similar interior dimensions as the first bag end and the second bag end, wherein the collapsible, elongated bag is disposable with the elongated shipping box.

15. The system of claim 13 further comprising:

at least two pouches, disposed substantially along the length of two interior sides of the portable, elongated bag; and at least two pliable, rigid inserts disposed within the at least two pouches to provide pliable, rigidity to the elongated bag.

16. The system of claim 13 wherein the extendible portion extends outward a shorter distance than the depth of one of a first padded insert and a second padded insert.

17. A system comprising:

a portable, elongated bag with two opposing ends closeable through the operation of at least one zipper extended from a first bag end to a second bag end;

a first padded insert and a second padded insert, each conformed to interior dimensions of one of the first bag end and the second bag end;

a second zipper running the circumference of one of the first end and the second end; and material making up an extendible portion of the portable, elongated bag held in a compressed position by the second zipper such that when the second zipper is unzipped, the extendible portion extends outward and one of the first padded insert and second padded insert compresses to fit securely within the extendible portion.

18. The system of claim 17 further comprising an elongated shipping box of corrugated material having two opposing ends, a first box end and a second box end, the first padded insert and the second padded insert each conformed to interior dimensions of one of the first box end and the second box end.

19. The system of claim 17 further comprising an elongated shipping box of corrugated material having two ends, a first box end and a second box end, the first box end and the second box end having substantially similar interior dimensions as the first bag end and the second bag end, wherein the collapsible, elongated bag is disposable with the elongated shipping box.

20. The system of claim 17 further comprising:

at least two pouches, disposed substantially along the length of two interior sides of the portable, elongated bag; and at least two pliable, rigid inserts disposed within the at least two pouches to provide pliable, rigidity to the elongated bag.

* * * * *